US005611193A

United States Patent [19]

Farrelly

[11] Patent Number: 5,611,193

[45] Date of Patent: Mar. 18, 1997

[54] TWO-AXIS ARTICLE LOADER/UNLOADER

[75] Inventor: Philip J. Farrelly, Short Hills, N.J.

[73] Assignee: Hudson Control Group, Inc., Springfield, N.J.

[21] Appl. No.: 381,532

[22] Filed: Jan. 31, 1995

[51] Int. Cl.[6] ..... B65B 5/10; B65B 21/12; B65B 35/36

[52] U.S. Cl. ..... 53/475; 53/245; 53/252; 53/534

[58] Field of Search ..... 53/475, 473, 443, 53/244, 534, 535, 536, 538, 251, 252, 250, 249, 247, 245, 246, 258

[56] References Cited

U.S. PATENT DOCUMENTS

| | | | |
|---|---|---|---|
| 2,924,919 | 2/1960 | Furst | 53/26 |
| 3,486,296 | 12/1969 | Hechenleitner | 53/160 |
| 3,685,624 | 8/1972 | Paddock | 53/245 X |
| 4,291,519 | 9/1981 | Johnson | 53/534 |
| 4,369,612 | 1/1983 | Wight | 53/534 X |
| 4,386,491 | 6/1983 | Cramer et al. | 53/247 |
| 4,428,175 | 1/1984 | Haab | 53/55 |
| 4,478,024 | 10/1984 | Vedvik et al. | 53/258 X |
| 4,600,065 | 7/1986 | Morris | 53/245 X |
| 4,827,692 | 5/1989 | Fiske et al. | 53/247 X |
| 4,901,504 | 2/1990 | Tsuji et al. | 53/247 |
| 4,905,456 | 3/1990 | Olaechea | 53/247 X |
| 5,060,455 | 10/1991 | Schmeisser | 53/448 |
| 5,212,930 | 5/1993 | Raudat | 53/263 |

*Primary Examiner*—James F. Coan
*Attorney, Agent, or Firm*—Rohm & Monsanto

[57] ABSTRACT

A loader arrangement is provided with a first conveyor for delivering an article to a first station, and a second conveyor for delivering a container to a respective first station. A gripper engages the article at the first station of the first conveyor, and a linear actuator, which is coupled to the gripper, moves the gripper along a first linear axis. Once the article has been engaged by the gripper, a rotator moves the linear actuator rotatively so that it parallels a second linear axis which is angularly displaced first the first linear axis. The gripper then is moved along the second linear axis, which is arranged to intersect with the first station of the second conveyor. A tilting arrangement is provided at one or both of the first stations for moving the container and/or the article arcuately to achieve an orthogonal orientation with respect to the second linear axis. At least one of the tilting arrangements is provided with an indexing system which moves the articles, or their containers, by a predetermined incremental distance which corresponds to the dimension of the product. The direction of the incrementation can be parallel with, or transverse to, the direction of the path of the conveyor. The invention incorporates a process for loading and unloading articles from a container. During the transfer of the article(s), a gripper rotator rotates the gripper to any desired angular extent to permit article columns or non-symmetrical articles to be loaded.

14 Claims, 3 Drawing Sheets

TWO-AXIS ARTICLE LOADER/UNLOADER

BACKGROUND OF THE INVENTION

1. Field of the Invention

This invention relates generally to robotic loader systems, and more particularly, to a two-axis arrangement for loading, unloading, and transferring articles between conveyor stations.

2. Description of the Related Art

Arrangements for loading and unloading articles between conveyor systems, or between containers and conveyor systems typically are expensive and complex. Generally, an overhead transport arrangement is employed to transfer the articles between the unloading and loading stations. For example; a mechanical gripper engages one or more articles at the unloading station; transports same in a first direction, typically upward, to clear the container, conveyor, or other mechanisms; utilizes the overhead transport arrangement to deliver the articles by horizontal travel to a location over the loading station; and transport the articles in a second direction, typically downward, into another container or conveyor at the loading station. Clearly, significant overhead structure, sufficient to span both stations, is required in this conventional arrangement. Programming of a variety of parameters, such as trolley travel distance, acceleration, etc., is required in an automated version of such an arrangement.

Such arrangements are generally quite massive and do not lend themselves to modifications in the manufacturing layout. The transom, or crane runway portion of the apparatus is fixed in its length, and is not readily movable. No variation in the path is permitted.

In addition to the foregoing, an overhead trolley arrangement poses problems with respect to cleanliness, particularly in areas where airborne matter is to be prevented. More specifically, it is difficult to enclose an elongated overhead trolley and track arrangement. This problem is compounded by the fact that the wheels or rollers of the trolley are continually wearing and require periodic lubrication. An overhead trolley arrangement can disperse lubricants and particles into the air, and will collect dust which can be released when the trolley is moved.

There is, therefore, a need for an arrangement for loading and unloading articles which does not require the use of massive or extensive overhead structure.

It is additionally a problem with trolley or shuttle arrangements that, as the rows of a container are loaded, the length of travel of the trolley must be incremented by a distance which corresponds to a dimension of the article(s) being loaded. Thus, a relatively massive combination, i.e., trolley and article, must be moved over incrementally varying distances, requiring a programmable high-powered motor arrangement. Such an arrangement is both, complex and expensive. In order to improve operating speed, it is necessary to employ motors rated for higher continuous power levels, and to strengthen the track on which the trolley travels and its associated support structure in view of the increased operating loads and accelerations.

It is, therefore, an object of this invention to provide a simple and inexpensive loading and unloading arrangement wherein articles such as bottles can be transferred between a container, on a container conveyor, and a transfer station on an article conveyor.

It is another object of this invention to provide a loading and unloading arrangement which transfers articles between at least to transfer stations without the need of a transfer trolley.

It is also an object of this invention to provide a loading and unloading arrangement which does not employ extensive or complex structure disposed over the loading or unloading stations. It is a further object of this invention to provide a loading and unloading arrangement wherein the moving parts and their associated bearings can readily and effectively be sealed.

It is additionally an object of this invention to provide a loading and unloading arrangement which can be utilized in an automated environment with reduced complexity of control system programming.

It is yet a further object of this invention to provide a loading and unloading arrangement which requires less maintenance than systems which employ overhead shuttle trolleys.

It is also another object of this invention to provide an unloading arrangement for removing articles from a container.

It is yet an additional object of this invention to provide a loading and unloading arrangement for unloading articles from a container and loading the articles onto a conveyor.

It is still a further object of this invention to provide a loading and unloading arrangement wherein the work which otherwise would be required to be performed by a trolley motor can be divided over several less powerful motors.

SUMMARY OF THE INVENTION

The foregoing and other objects are achieved by this invention which provides in an apparatus aspect thereof, an article transfer arrangement for loading and unloading articles between first and second conveyors. In accordance with the invention, the article transfer arrangement is provided with a gripper for gripping a plurality of the articles, the articles being arranged in series with one another at a first station of the first conveyor. A linear actuator is coupled to the gripper for moving the gripper along a first linear axis, which is arranged to intersect the first conveyor. A rotator arrangement, which is coupled to the linear actuator, rotates the linear actuator whereby the gripper is directed to be moved along a second linear axis, the second linear axis being arranged to intersect the second conveyor. The first and second linear axes are therefore arcuately displaced with respect to one another.

In one embodiment of the invention, the first conveyor is provided with a respectively associated first station disposed in the vicinity where the first linear axis intersects the first conveyor. The first conveyor is arranged to transport the articles, which may be, in a specific illustrative embodiment of the invention, a plurality of sequentially conveyed bottles.

The second conveyor is arranged to convey containers, illustratively cartons or crates, which are filled or can be filled with the articles. The second conveyor is arranged to transport the containers along a predetermined second conveyor path, which path has a respective first station arranged in the vicinity where the second conveyor is intersected by the second axis along which the linear actuator is moved. In this embodiment, the loading/unloading station of the first conveyor is arranged to be substantially parallel with the unloading/loading station of the second conveyor.

In a highly advantageous embodiment of the invention, the unloading/loading station of the second conveyor is provided with an arrangement for tilting the container, in a direction transverse to the predetermined conveyor path. The extent of the tilting is determined in accordance with a desired predetermined angle between the container being loaded/unloaded and the second linear axis. In one embodiment, the container is tilted so as to be substantially orthogonal with respect to the second linear axis.

In addition to the tilting arrangement, the unloading/loading station of the second conveyor is further provided with an indexing arrangement whereby the tilted container is moved by predetermined increments of distance. Generally, the length of the incremental distance is determined in response to the dimension of the article being loaded/unloaded. In one embodiment, the indexing is achieved in a direction substantially orthogonal to the second conveyor path. However, indexing can be achieved in a direction which is substantially parallel to the second conveyor path.

In a still further embodiment of this aspect of the invention, there is additionally provided a gripper rotator for rotating the gripper. The gripper rotator is arranged sequentially with respect to the linear actuator, and is useful in situations where the articles must be rotated during loading/unloading. This facilitates the loading of columns of articles, rather than rows of articles.

It is a significant aspect of the present invention that the overall work required to be performed in the loading and unloading of articles is divided over a plurality of motors, thereby avoiding the need to provide a single powerful motor, and its associated support structure, to perform the bulk of the work. This results in reduction of motor costs, structure costs, and the costs associated with the control systems. More specifically, in the context of the present invention, the work associated with the transportation of the article(s) between loading/unloading stations is performed by a single motor which, in a specific illustrative embodiment of the invention, moves the article(s) over a fixed arcuate distance, along a path which resembles that of a pendulum. In such an embodiment of the invention, gravity will assist in effecting the travel. In addition, the increase in the incremental distance required to be traveled by the transport mechanism is accommodated by a second motor which increments the position of the container between loading operation. This incrementing motor can be of significantly lower power than other wise would be required because it makes use of the fact that a relatively long period of time is required between loading cycles. Therefore, the incrementing motor can operate at significantly lower speed, and therefore at lower power, than that of the transport motor. In effect, the present invention permits higher operating speeds to be achieved with lower capacity motors.

In accordance with a further apparatus aspect of the invention, a loader arrangement is provided with a first conveyor having a first station for delivering an article to the first station, and a second conveyor having a respective first station for delivering a container to its respective first station. A gripper grips the article at the first station of the first conveyor, and a linear actuator, which is coupled to the conveyor, moves the gripper along a first linear axis. A rotator which is coupled to the linear actuator moves same rotatively whereby it parallels a second linear axis which is angularly displaced from the first linear axis. The gripper is therefore movable along the second linear axis, which is arranged to intersect with the first station of the second conveyor. A tilting arrangement is provided at the first station of the second conveyor for moving the container arcuately whereby the container achieves a predetermined angular orientation with respect to the second linear axis.

In a specific embodiment of the invention, the predetermined angular orientation of the container with respect to the second linear axis corresponds to a substantially orthogonal relationship with respect thereto. In other embodiments of the invention, tilting is achieved at both, the first station of the second conveyor, and the first station of the first conveyor, and in each such first station, the tilting mechanism is adjusted to achieve a predetermined angular relationship with respect to the respective ones of the first and second linear axes. This arrangement would be particularly useful when it is desired to transfer articles from one container to another.

As previously discussed, at least one of the tilting arrangements is provided with an indexing system which moves the articles, or their cartons or containers, by a predetermined incremental distance. Also, as previously stated, the direction of the incrementation can be either parallel with, or transverse to, the direction of the path of the conveyor.

In accordance with a method aspect of the invention, the following steps are provided:

first moving a gripper arrangement along a first path toward an article on a first conveyor;

engaging the article with the gripper;

withdrawing the article from the first conveyor;

second moving the gripper with the article engaged therewith along an arcuate path;

third moving the gripper with the article engaged therewith along a second path toward a container on a second conveyor;

prior to completing said step of third moving, tilting the container whereby it is arranged substantially orthogonal to said second path; and releasing the article in the container.

In accordance with an embodiment of the method aspect of the invention, the step of first moving includes the step of operating a linear actuator which is coupled to the gripper. The first path is a first linear path along a first axis of travel. In this embodiment, the step of withdrawing is performed along the first linear path. The step of first moving includes the step of operating a linear actuator which is coupled to the gripper, and in this embodiment, the second path is second linear path along the second axis of travel.

The steps of first moving, engaging, withdrawing, second moving, and third moving are repeated during continuous operation of the arrangement.

In accordance with a further method aspect of the invention, articles are unloaded from a container in accordance with the following steps:

first rotating a gripper arrangement until it is movable along a first path;

tilting the container until it is arranged substantially orthogonal to said first path;

first moving the gripper arrangement along said first path toward an article at a first article location in the container;

engaging the article in the container with the gripper;

withdrawing the article from the first conveyor in a reverse direction with respect to said step of first moving, along said first path;

second rotating a gripper arrangement until it is movable along a second path;

second moving said gripper arrangement along said second path toward an article deposit station; and releasing the article at said article deposit station.

In accordance with this unloading method aspect of the invention, the article deposit station is arranged on an article conveyor for conveying the article after performance of the step of releasing. There is additionally provided, as previously noted, a container conveyor, the step of tilting the container being performed at an unloading station of the container conveyor.

After performing the step of withdrawing, there are provided the further steps of untilting the container until it is oriented substantially parallel to the container conveyor, and conveying a further container into the unloading station of the container conveyor. The process steps, set forth hereinabove with respect to the further method aspect of the invention, are then repeated, and the container is indexed, as stated hereinabove.

BRIEF DESCRIPTION OF THE DRAWING

Comprehension of the invention is facilitated by reading the following detailed description, in conjunction with the annexed drawing, in which.

DETAILED DESCRIPTION

Figure 1:
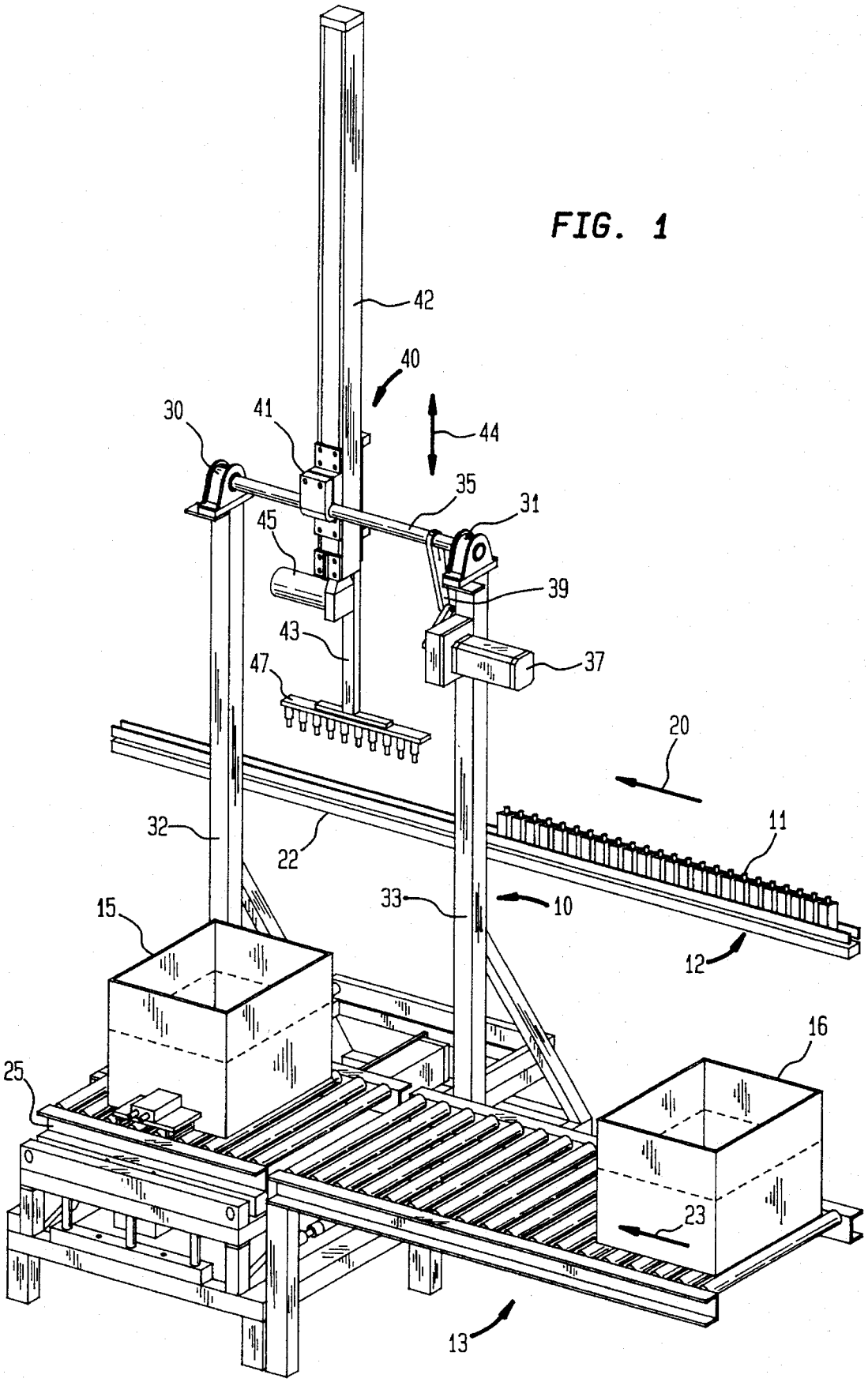
FIG. 1 is a partially schematic isometric representation of a loader/unloader arrangement constructed in accordance with the principles of the invention, the arrangement being in the condition of receiving a container for loading with bottles.

FIG. 1 is a partially schematic isometric representation of a loader/unloader arrangement 10 which is arranged to transfer articles, illustratively a plurality of bottles 11 between a first conveyor 12 and a second conveyor 13 which transports containers 15 and 16.

First conveyor 12 is shown schematically to support bottles 11 in serial orientation and transports them in the direction of arrow 20. The bottles are transported by the first conveyor to a transfer station 22 which, as will be described hereinbelow, is disposed in the region directly below the transfer mechanism (described below) of loader/unloader arrangement 10.

Second conveyor 13 transports containers, such as container 16, in the direction of arrow 23. The containers are each in turn moved to a load/unload station 25 of the second conveyor.

In this specific illustrative embodiment of loader/unloader arrangement 10, a pair of pillow blocks 30 and 31 are mounted on respective ones of support posts 32 and 33 and rotatively coupled with a common shaft 35. The rotation of shaft 35 is effected by operation of a drive unit 37 which is coupled to shaft 35 by a linkage arrangement 39. It is to be understood that the present invention includes within its scope any drive arrangement which can cause a shaft, such as shaft 35, to be rotated over at least a limited predetermined angular range.

In this embodiment of the invention, a linear actuator 40 is coupled to shaft 35 by means of a shaft coupler 41. The shaft coupler fixedly couples the linear actuator to shaft 35 such that the linear actuator is rotatable, as will be shown hereinbelow with respect to FIG. 2, when shaft 35 is rotated.

In this specific embodiment, linear actuator 40 is formed of a frame 42 which supports a translatable linear shaft 43. Linear shaft 43 is translatable in the directions shown by arrow 44 in response to linear drive unit 45. A multi-bottle gripper arrangement 47 is coupled at the downwardmost end of linear shaft 43, and as will be described hereinbelow, is adapted to engage with and hold a plurality of bottles 11.

Figure 2:
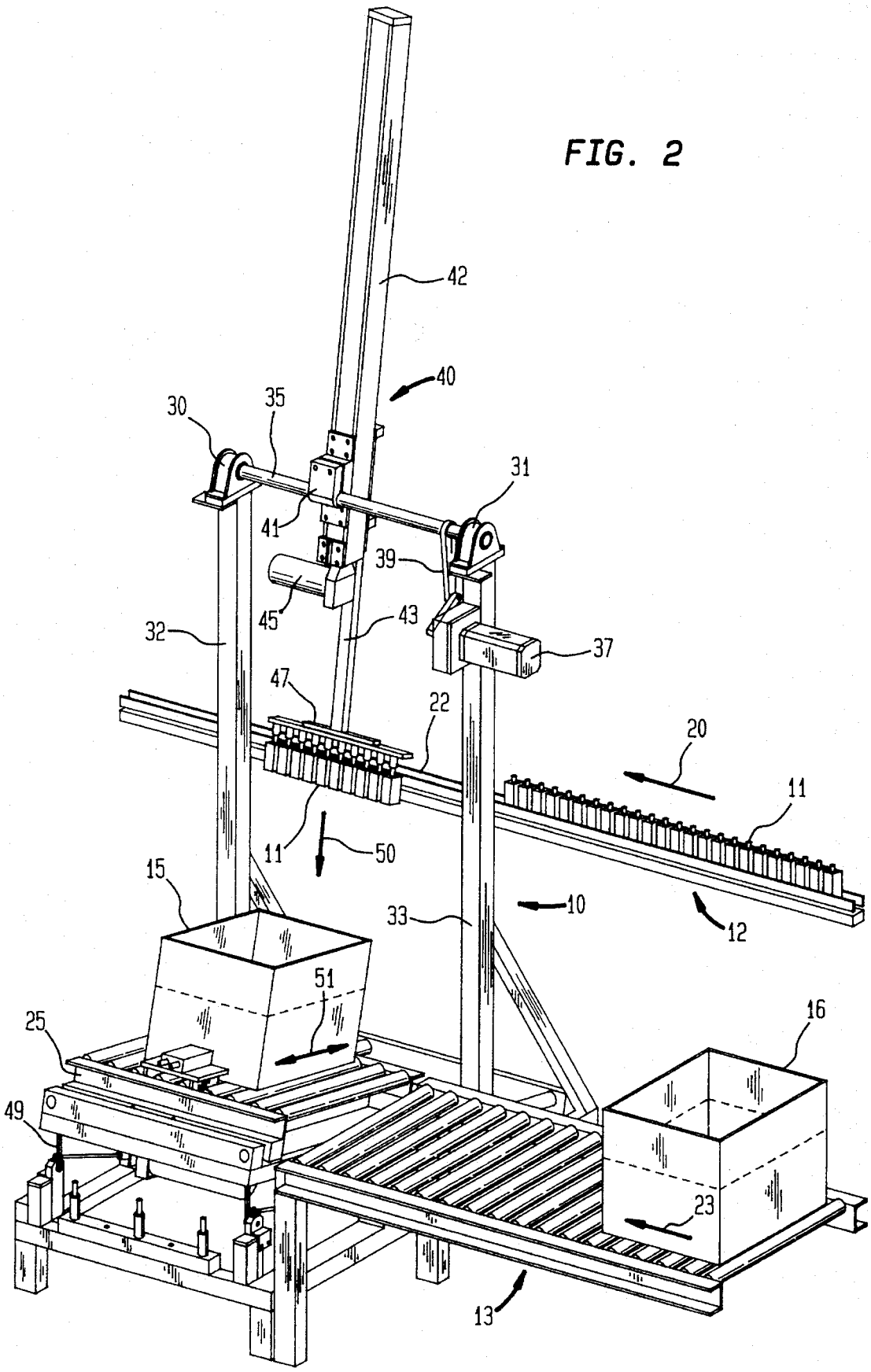
FIG. 2 is a partially schematic isometric representation of the loader/unloader arrangement of FIG. 1, the arrangement being shown in the process of loading a plurality of bottles into the container.

FIG. 2 is a partially schematic isometric representation of loader/unloader arrangement 10, which is shown in the process of loading a plurality of bottles 11 into container 15. In this figure, elements of structure which bear analogous correspondence to those in FIG. 1 are similarly designated.

In FIG. 1, linear shaft 43 and gripper arrangement 47 were arranged to be directly over transfer station 22 of first conveyor 12. FIG. 2, however, shows a plurality of bottles 11 to have been picked-up by gripper arrangement 47. In addition, shaft 35 has been rotated by operation of drive unit 37, and linkage arrangement 39 so as to be directed toward the interior of container 15. In other words, a longitudinal axis (not shown) of linear shaft 43 was arranged in the condition shown in FIG. 1 to intersect with transfer station 22 of first conveyor 12. However, in FIG. 2, the longitudinal axis (not shown) associated with linear shaft 43 is directed to intersect with load/unload station 25, and particularly, container 15.

FIG. 2 further shows that load/unload station 25 has been tilted upward, illustratively by operation of tilting mechanism 49, such that the floor (not shown) of container 15 is substantially orthogonal to the longitudinal axis of linear shaft 43. Once linear shaft 43 has been moved to the position shown in FIG. 2, and container 15 has been tilted, the linear shaft is urged in the direction of arrow 50 whereupon the bottles which are coupled to gripper arrangement 47 are deposited into container 15.

For each row of bottles deposited into container 15, the container is indexed by being moved in the direction of arrow 51. In this embodiment of the invention, arrow 51 indicates a direction of indexing travel which is transverse to a path defined by second conveyor 13, and such indexing prevents subsequent rows of the bottles from being deposited onto previously deposited row thereof.

Figure 3:
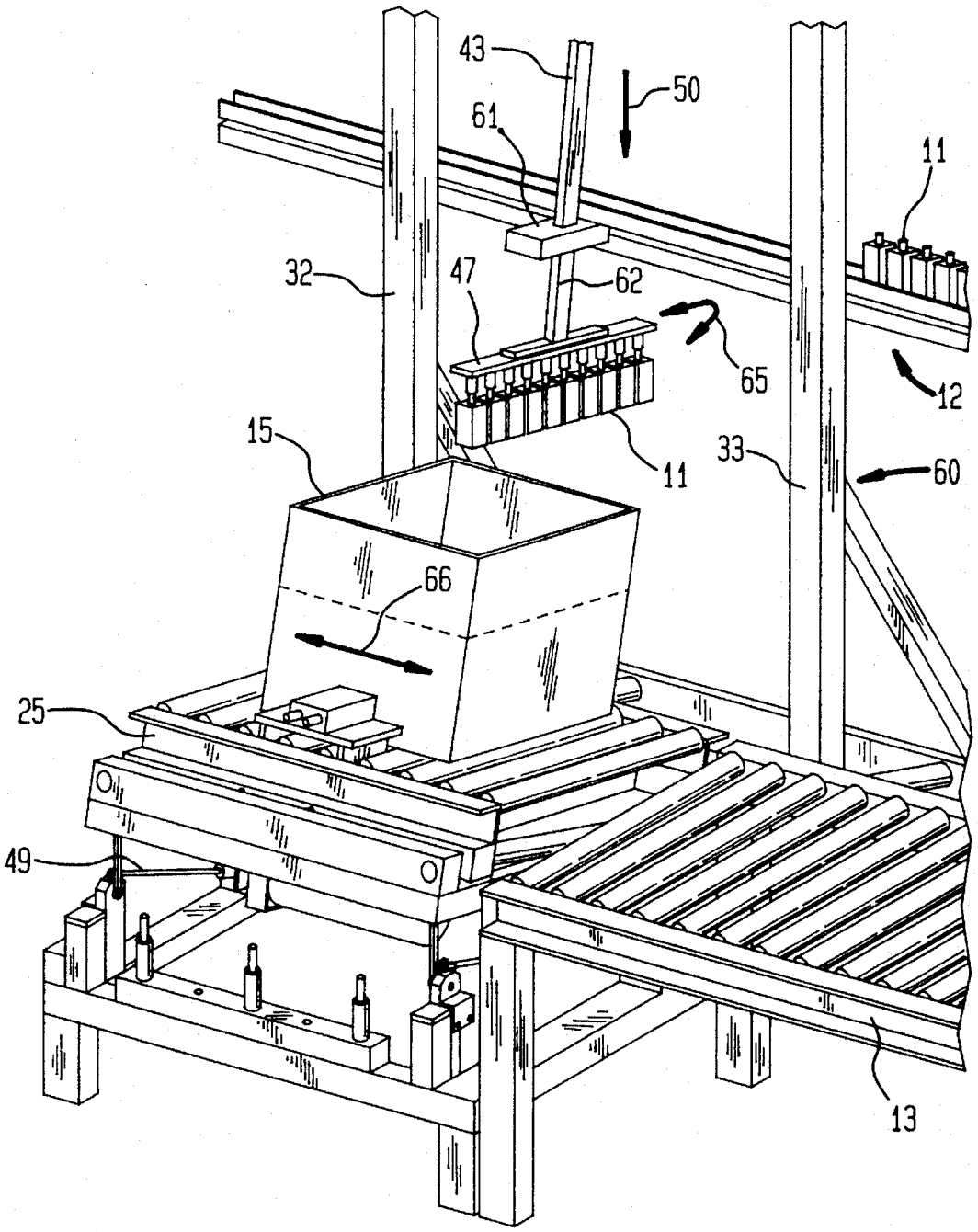
FIG. 3 is a partially schematic isometric representation of a loader/unloader arrangement constructed in accordance with the principles of the invention, and showing rotation of the picked-up articles with respect to FIG. 2.

FIG. 3 is a partially schematic isometric representation of a loader/unloader arrangement 60 which is similar to that shown in FIGS. 1 and 2. Accordingly, elements of structure which bear analogous correspondence to the embodiments shown in FIGS. 1 and 2 are similarly designated. In this embodiment, linear shaft 43 is not directly coupled to the gripper arrangement, but instead is coupled to a rotator 61. Rotator 61 is provided with an output shaft 62 which is coupled to gripper arrangement 47. However, output shaft 62 is rotatable with respect to linear shaft 43, and therefor, the gripper arrangement is rotatable in the direction indicated by arrow 65. Once the gripper arrangement has been rotated so as to be substantially orthogonal to the orientation shown in FIG. 2, linear shaft 43, as previously described, is moved in the direction of arrow 50 such that a column of bottles 11 is deposited in container 15. In this embodiment, container 15 is indexed in the direction of arrow 66 so that subsequently deposited columns of bottles 11 are not deposited on previously deposited columns thereof. Thus, in this embodiment, the indexing of container 15, in its tilted condition at load/unload station 25 is performed in a direction which is substantially parallel to the conveyor path defined by second conveyor 13.

Further in accordance with the specific illustrative embodiment of the invention described with respect to FIG.

3, it is to be understood that rotator 61 can be employed to rotate gripper arrangement 47 180° or more, and is not limited to the 90° rotation shown in FIG. 3. A rotation of 180° is particularly useful when loading non-symmetrical articles into containers. Of course, any amount of rotation is intended to be included within the scope of the present invention, including multiple complete rotations at any desired angle of linear shaft 43.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A loader arrangement for loading articles, the loader arrangement comprising:

a first conveyor for supplying a plurality of the articles to be unloaded therefrom, the plurality of articles being conveyed along a predetermined first conveyor path to an unloading station thereof where the articles are accumulated;

a second conveyor for supplying a plurality of containers into which the articles are to be loaded, the plurality of containers being conveyed along a predetermined second conveyor path, said second conveyor having a loading station where at least one of the containers into which the articles are to be loaded is deposited, the containers being delivered to the loading station at a first predetermined orientation with respect to the horizontal;

container tilt means disposed at the loading station for moving the deposited container arcuately from the first predetermined orientation with respect to the horizontal to a second predetermined orientation with respect to the horizontal;

gripper means for gripping a group of a predetermined number of the plurality of the articles, the articles being arranged in series with one another at the unloading station of the first conveyor;

linear actuator means coupled to said gripper means for moving said gripper means and the group of gripped ones of the plurality of the articles along a first linear axis substantially orthogonal to the direction of travel of the plurality of articles along said first conveyor, said first axis being arranged to intersect with the first conveyor; and rotator means coupled to said linear actuator means for rotating said linear actuator means, whereby said gripper means is displaced arcuately to a second axis, and moved in response to said linear actuator means along the second axis, the second axis being linear and arranged to intersect with the second conveyor, the first and second axes being arcuately displaced with respect to one another so as to define a predetermined angle therebetween; the second axis being substantially orthogonal to the second predetermined orientation with respect to the horizontal.

2. The loader arrangement of claim 1 wherein there is further provided transverse indexing means for moving the container in predetermined increments of distance in a direction transverse to the predetermined second conveyor path.

3. The loader arrangement of claim 1 wherein there is further provided means for supporting a container on the second conveyor and transporting same along the predetermined second conveyor path.

4. The loader arrangement of claim 1 wherein there is further provided parallel indexing means for moving the container in predetermined increments of distance in a direction substantially parallel to the predetermined second conveyor path.

5. The loader arrangement of claim 1 wherein the unloading station of the first conveyor and the loading station of the second conveyor are arranged substantially parallel to one another.

6. The loader arrangement of claim 4 wherein there is further provided gripper rotator means for rotating said gripper means.

7. A method of unloading articles from a container, the method comprising the steps of:

first rotating a linear actuator having a gripper arrangement coupled thereto until the gripper arrangement is movable along a first path;

conveying the container along a container conveyor to an unloading station in a first predetermined orientation with respect to the horizontal;

tilting the container at the unloading station from the first predetermined orientation to a second predetermined orientation with respect to the horizontal where it is arranged substantially orthogonal to the first path of the gripper arrangement;

first moving the gripper arrangement along the first path toward an article at a first article location in the container;

engaging the article at the first article location in the container with the gripper arrangement;

withdrawing the article from the first conveyor in a reverse direction with respect to said step of first moving, along said first path;

second rotating the linear actuator until the gripper arrangement is movable along a second path, the second path being orthogonal to an article conveyor;

second moving said gripper arrangement along said second path toward an article deposit station of the article conveyor;

releasing the article at the article deposit station; and removing the article from the deposit station along the article conveyor in a direction substantially orthogonal to the second path of the gripper arrangement.

8. The method of claim 7, wherein after performing said step of withdrawing there are provided the further steps of:

untilting the container until it is arranged substantially parallel to the container conveyor; and conveying a further container to the unloading station of the container conveyor.

9. The method of claim 7, wherein there is further provided the step of indexing the container laterally along the second predetermined orientation with respect to the horizontal whereby upon repeating said step of first moving, the gripper arrangement is moved along the first path toward an article at a second article location in the container.

10. A method of loading articles into a container, the method comprising the steps of:

first moving a gripper arrangement along a first linear path toward an article on a first conveyor;

engaging the article with the gripper;

withdrawing the article from the first conveyor in a direction that is substantially orthogonal away from the first conveyor;

conveying the container along a second conveyor at a first predetermined orientation with respect to the horizontal to a loading station;

receiving the container at the loading station at the first predetermined orientation with respect to the horizontal;

actuating a tilting arrangement at the loading station whereby the received container is tilted to a second predetermined orientation with respect to the horizontal;

second moving the gripper with the article engaged therewith along an arcuate path;

third moving the gripper with the article engaged therewith along a second path toward the tilted container on the second conveyor, the second path being substantially orthogonal to the second predetermined orientation with respect to the horizontal of the container; and releasing the article in the container.

11. The method of claim 10, wherein prior to performing said step of releasing there is provided the further step of rotating the gripper in a plane of rotation which is substantially orthogonal to a longitudinal axis of the linear actuator.

12. The method of claim 10, wherein there is further provided the step of repeating said steps of first moving, engaging, withdrawing, second moving, and third moving, and wherein prior to completing said step of third moving, there is provided the step of indexing the container whereby it is moved along its tilted orientation for a predetermined increment of distance.

13. The method of claim 12, wherein there is further provided the step of repeating said step of releasing.

14. The method of claim 13, wherein there is further provided the step of repeating said step of indexing.

* * * * *